US010837117B2

(12) United States Patent
Zimmermann et al.

(10) Patent No.: US 10,837,117 B2
(45) Date of Patent: Nov. 17, 2020

(54) METHOD FOR COATING AN OBJECT BY MEANS OF A MULTILAYER SYSTEM WITH A NICKEL-PHOSPHORUS ALLOY

(71) Applicant: Grohe AG, Hemer (DE)

(72) Inventors: Christian Zimmermann, Hemer (DE); Mark Bobzien, Gelsenkirchen (DE)

(73) Assignee: Grohe AG, Hemer (DE)

( * ) Notice: Subject to any disclaimer, the term of this patent is extended or adjusted under 35 U.S.C. 154(b) by 0 days.

(21) Appl. No.: 16/166,676

(22) Filed: Oct. 22, 2018

(65) Prior Publication Data

US 2019/0055664 A1 Feb. 21, 2019

Related U.S. Application Data

(63) Continuation of application No. PCT/EP2017/000498, filed on Apr. 19, 2017.

(30) Foreign Application Priority Data

Apr. 22, 2016 (DE) ..... 10 2016 004 913

(51) Int. Cl.

| | |
|---|---|
| ***C23C 28/00*** | (2006.01) |
| ***C25D 5/10*** | (2006.01) |
| ***C25D 5/12*** | (2006.01) |
| ***C25D 5/14*** | (2006.01) |
| ***C25D 3/56*** | (2006.01) |
| ***C25D 3/06*** | (2006.01) |
| ***C25D 3/08*** | (2006.01) |
| ***C23C 28/02*** | (2006.01) |
| *C25D 3/12* | (2006.01) |
| *C25D 5/56* | (2006.01) |

(52) U.S. Cl.

CPC ..... *C25D 5/14* (2013.01); *C23C 28/023* (2013.01); *C23C 28/322* (2013.01); *C23C 28/34* (2013.01); *C23C 28/343* (2013.01); *C25D 3/06* (2013.01); *C25D 3/08* (2013.01); *C25D 3/562* (2013.01); *C25D 3/12* (2013.01); *C25D 5/56* (2013.01)

(58) Field of Classification Search

CPC . C23C 18/1651; C23C 18/1653; C23C 28/00; C25D 5/10; C25D 5/12; C25D 5/14

USPC ..... 427/404; 205/170, 176, 178, 180, 181, 205/182, 183, 191, 197

See application file for complete search history.

(56) References Cited

U.S. PATENT DOCUMENTS

2004/0005473 A1* 1/2004 Matteucci ..... C08L 23/04 428/515
2011/0165435 A1* 7/2011 Rost ..... C23C 14/0635 428/634
2018/0266004 A1* 9/2018 Konigshofen ..... C25D 3/06

FOREIGN PATENT DOCUMENTS

DE 4430430 C1 12/1995
DE 102008046673 A1 3/2010
(Continued)

OTHER PUBLICATIONS

International Search Report dated Jun. 8, 2017 in corresponding application PCT/EP2017/000498.

*Primary Examiner* — Edna Wong
(74) *Attorney, Agent, or Firm* — Muncy, Geissler, Olds & Lowe, P.C.

(57) ABSTRACT

A method for coating an article, wherein a surface of the article is at least partially coated with a coating that has a multiplicity of layers, wherein at least one layer of the coating is made of a nickel phosphorus alloy and wherein a mass fraction of the phosphorus in the nickel phosphorus alloy is at least 8%.

5 Claims, 2 Drawing Sheets

(56) References Cited

FOREIGN PATENT DOCUMENTS

| | | | | |
|---|---|---|---|---|
| WO | WO-2014111616 A1 * | 7/2014 | ..... | C23C 12/00 |
| WO | WO-2015107256 A1 * | 7/2015 | ..... | C25D 3/06 |
| WO | WO2015107256 A1 | 7/2015 | | |

* cited by examiner

METHOD FOR COATING AN OBJECT BY MEANS OF A MULTILAYER SYSTEM WITH A NICKEL-PHOSPHORUS ALLOY

This nonprovisional application is a continuation of International Application No. PCT/EP2017/000498, which was filed on Apr. 19, 2017, and which claims priority to German Patent Application No. 10 2016 004 913.8, which was filed in Germany on Apr. 22, 2016, and which are both herein incorporated by reference.

BACKGROUND OF THE INVENTION

Field of the Invention

The present invention relates to a method for coating an article using a multilayer system. Such multilayer systems are used as corrosion protection and/or as decorative coatings, for example. In particular, the intent is for articles of sanitary facilities, such as, e.g., plumbing fixtures, to be produced or finished using the method specified here.

Description of the Background Art

Multilayer systems based on electrochemically deposited metal layers can produce corrosion products as a function of the employed substrates, layer materials, surrounding media, and reaction conditions. Moreover, the process of corrosion depends on geometric circumstances (for example, resulting in crevice corrosion) and mechanical influences (for example, friction). The causes of corrosion can be diverse, and generally occur in combination. Mentioned here by way of example are electrochemical potential differences between the layers and substrate material flaws (for example, seams).

Multilayer systems based on electrochemically deposited copper layers, nickel layers, and chromium layers are known from the prior art. In these systems, different nickel layers are usually used as a multilayer structure (semibright nickel, bright nickel, microporous nickel). Corrosion protection of the coated component is enhanced by a subsequent chromium plating from an electrolyte containing chromium(VI) or chromium(III). Almost without exception, a chromium layer protects nickel layers from rapid corrosion attack. Damaged chromium coatings, but also coatings with chromium layers that are not fully continuous, that were deposited too thinly, or that are porous, soon (depending on external conditions such as usage, cleaning, and surrounding media) result in corrosion products that are visually unsightly, and can lead to component failure in susceptible substrate materials.

SUMMARY OF THE INVENTION

It is therefore an object of the present invention to provide a method for coating an article, in particular a sanitary article, with which it is possible to create surfaces that are both corrosion-inhibiting and decorative.

In an exemplary embodiment of the method according to the invention for coating an article, a surface of the article is at least partially coated with a coating that has a multiplicity of layers, wherein at least one layer of the coating is made of a nickel phosphorus alloy and wherein a mass fraction of the phosphorus in the nickel phosphorus alloy is at least 8%.

The subject matter is a substrate made of an arbitrary solid material that has a surface, but preferably is a sanitary article, as for example a plumbing fixture, which is used, in particular, in connection with washbasins, sinks, showers, and/or bathtubs. Such plumbing fixtures serve, in particular, to draw water, and may include actuators for a water temperature and/or a draw volume of the water, and are commonly used in an area that is visible to the user, so they should have a decorative surface on the one hand, and must be efficaciously protected against corrosion on the other hand. The surface of the article is coated at least partially or completely with a coating having a multiplicity of layers. The coating is a multilayer system, with which it is possible to produce decorative and/or functional surfaces, in particular. To this end, the individual layers are formed sequentially, in particular, and/or differ in their material composition. The individual layers preferably each have a layer thickness of 5 μm (micrometers) to 100 μm, preferably 8 μm to 80 μm. At least one of the multiplicity of layers of the coating is made of a nickel phosphorus alloy, wherein a mass fraction of the phosphorus in the nickel phosphorus alloy is at least 8%. The mass fraction of the phosphorus in the nickel phosphorus alloy is preferably 8% to 14%, especially preferably 10% to 12%. At least the layer made of the nickel phosphorus alloy is electrolytically deposited on the article. Moreover, additional layers or all layers of the coating can also be electrolytically deposited on the article. For this purpose, the article is at least partially dipped in an electrolytic solution, in particular. In the multilayer system, the nickel phosphorus alloy takes on the function of corrosion protection. Consequently, the nickel phosphorus alloy prevents corrosion of the article to a great degree, and thus improves the corrosion properties of, in particular, decorative coatings with a functional character. Damage, or coatings that are not fully continuous or are porous, therefore result in a significantly reduced progress of corrosion of the article, so that component failure and/or visual impairment are avoided.

Moreover, it is advantageous if the article is made of copper, zinc, aluminum, steel, plastic, or an alloy that includes copper, zinc, or steel. Water-carrying sanitary articles, as for example single-lever mixers and/or spouts, can be made at least partially of copper alloys (brass, bronze). Many attachments in the plumbing industry are made of die-cast zinc (for example levers for single-lever mixers, housings, and/or spouts). Decorative die-cast zinc parts are used in the automotive industry, as well (for example interior door handles, key parts, and/or console elements). Plastics are chromium-plated for decorative purposes in the plumbing field for caps, flush plates, rosettes, and/or sleeves. For the most part, ABS (acrylonitrile butadiene styrene) or blended materials of ABS/PC (PC=polycarbonate) in various proportions are used here. In the automotive industry, these materials are also used in the chromed state, for example for trim strips, radiator grills, and/or control elements. Furthermore, PA (polyamide) or PA/GF (glass-fiber reinforced polyamide) are decoratively coated with chromium for certain applications here (for example interior door handles). In addition, decoratively chromium-plated articles have numerous applications in other industries (housewares, white goods, etc.). Galvanically chromium-plated steel parts are likewise used in numerous industries, as, for example, the furniture industry (chair frames), the automotive industry (attachments, ashtrays, headrest supports, etc.). Aluminum is used in the plumbing industry, for example in the area of shower enclosures and bathroom furniture.

In addition, it is advantageous if a first layer of the coating is made of copper or nickel. The first layer of the coating is the layer that is applied directly to the surface of the body.

The visual surface quality that is required for the production of high-quality chromium surfaces can be achieved by means of the copper or nickel layer. When electrolytically deposited, both metals can even out surface defects (scratches, fine lines, pores) and significantly enhance the luster of the finished surfaces. Moreover, the corrosion resistance of the body can be increased, and in the case of plastic bodies, the adhesion of the finished coating to the body can be significantly improved by the ductility of copper.

In addition, it is advantageous if an additional layer of the coating is made of bright nickel, semibright nickel, or matte nickel. The additional layer is applied directly on the first layer, in particular.

Bright nickel layers have the greatest importance of all nickel layers. The focus here is on the decorative application. Bright nickel baths contain various brighteners. These agents produce a fine-crystalline structure, and thus a brilliant, highly lustrous layer. Chromium deposited on this layer produces a highly lustrous surface that is generally known and is the most widespread.

Semibright nickel layers are not deposited because of their low level of luster, but instead in order to meet special corrosion-related requirements. Semibright nickel layers should always be considered together with the bright nickel layer. They are usually deposited before the bright nickel layer, and improve the corrosion properties of the composite because of their electrochemical potential.

Matte nickel layers are nickel layers that have largely nonglare properties due to their composition. Usually, certain substances are added to the electrolyte that influence the nickel deposition. Since the purpose of these layers is to achieve a certain appearance, these layers usually are deposited directly prior to the chromium plating (often as a substitute for bright nickel layers). In this process, the color and matte appearance can be controlled within certain limits by the process parameters.

It is likewise advantageous if a third layer of the coating is made of the suggested nickel phosphorus alloy. The third layer is applied directly on the second layer, in particular.

It is likewise advantageous if a fourth layer of the coating is a chromium layer. The fourth layer is applied directly on the third layer, in particular.

In addition, it is advantageous if the chromium layer is deposited from hexavalent or trivalent chromium electrolyte. A chromium layer made of a hexavalent chromium electrolyte is especially corrosion-resistant in this context, and provides very good visual surface qualities.

A chromium layer made of a trivalent chromium electrolyte is especially suitable and preferred from the perspective of occupational safety and for environmental reasons.

Moreover, it is advantageous if a fifth layer of the coating includes at least a zirconium compound, a chromium compound, or a titanium compound. Mixtures of these compounds are also possible in the fifth layer. The fifth layer is applied directly on the fourth layer, in particular. The purpose of this coating is to produce a particular color. For example, red tones, gold tones, or stainless steel appearance are achieved with this layer on galvanically deposited chromium layers. The composition of these layers determines the color achieved here. These layers usually are composed of zirconium nitride (ZrN), titanium nitride (TiN), and/or chromium nitride (CrN) in various proportions.

The fifth layer can be produced through physical vapor deposition (PVD process).

The fifth layer can be produced from an amorphous carbon layer. The amorphous carbon layer is, in particular, a diamond-like carbon layer (DLC="diamond-like carbon").

At least the nickel phosphorus alloy can be applied electrolytically. This method can be carried out significantly faster than autocatalytic application, for example, and is thus better suited for large-scale industrial production. In addition to the nickel phosphorus alloy, other layers can also be applied electrolytically, as for example the chromium layer.

Another very particular advantage of the invention is achieved when the chromium layer is applied directly on the nickel phosphorus alloy. The corrosion resistance of the chromium layer is especially improved by this means. If, in addition, a chromium layer made of a trivalent chromium electrolyte is applied electrolytically on the nickel phosphorus alloy, it is particularly also possible with this electrolyte to achieve especially good corrosion resistance, which is substantially better than previously known coatings of trivalent chromium. These advantages are achieved through the direct combination of the nickel phosphorus alloy with the chromium layer applied thereon. This combination can be used in different locations within the framework of a layer structure according to the invention, and can achieve the previously described positive technical effect there. Thus, the layer pairing can also be used in the advantageous manner as, for example, a first and second layer or as a second and third layer of a layer structure.

In addition, it is advantageous if a brush structure is introduced in the coating. The application of a brush structure is generally carried out in conjunction with the above-mentioned PVD coating. The resulting final surfaces are "brushed stainless steel" or "brushed nickel," for example. The brushing is carried out by pressing the articles against rotating disks. These disks may be polishing disks with suitable polishing pastes, fiber brushes, or sisal brushes, for example. This step is carried out before PVD coating, or even before the chromium plating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
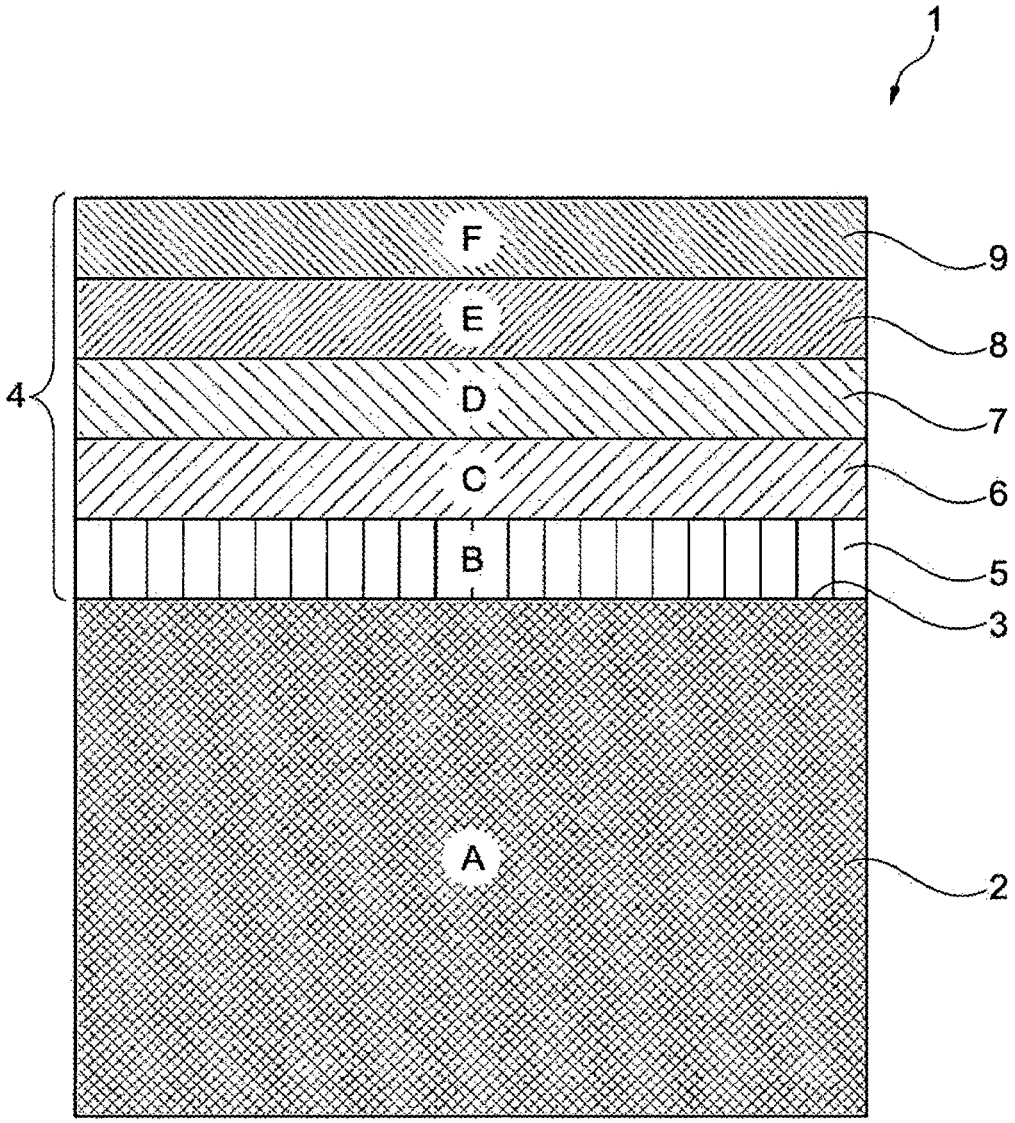
FIG. 1 shows an article coated with the method according to the invention in a longitudinal section.

FIG. 1 shows a coated article 1 in a longitudinal section, which has a body 2 with a surface 3. The surface 3 is coated with a coating 4, which has a first layer 5, a second layer 6, a third layer 7, a fourth layer 8, and a fifth layer 9. In the case of the variant embodiment of the invention proposed here, for example, the body 2 is steel, the first layer 5 is copper, the second layer 6 is matte nickel, the third layer 7 is a nickel phosphorus alloy, and the fourth layer 8 is a chromium layer. The fifth layer 9 includes a zirconium compound.

Figure 2:
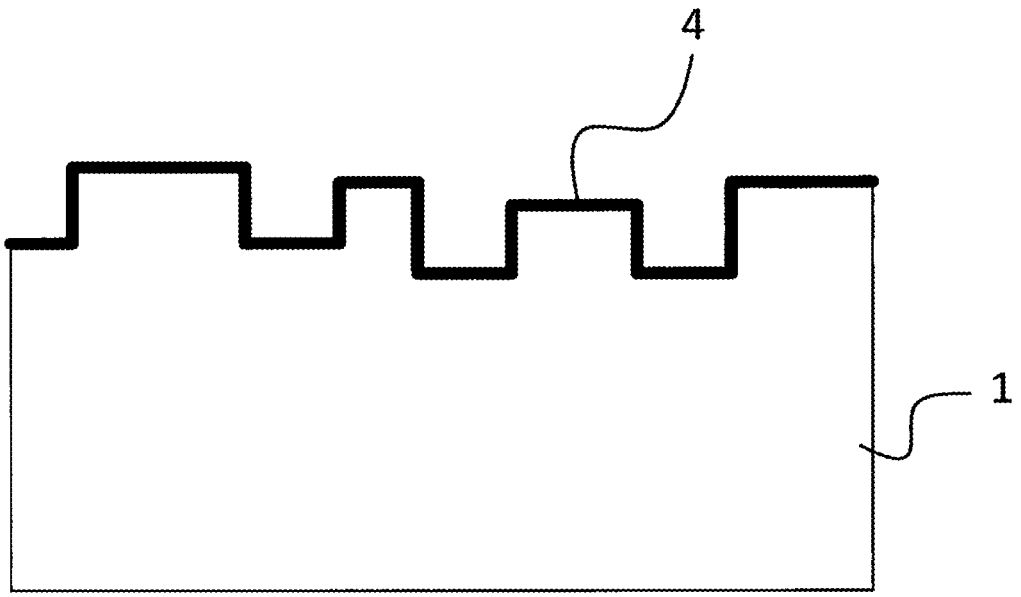
Fig. 2 (Conventional Art)
FIG. 2 shows an article coated with the autocatalytic method according to the conventional art in a longitudinal section.

In FIG. 2, a coated article 1 with a coating according to the conventional art is shown. The coating 4 here is applied by means of an autocatalytic coating method. The autocatalytic coating method is very slow, and thus time-consuming. Moreover, constant layer thicknesses are produced over all the contours in the autocatalytic coating method. This layer thickness is represented in FIG. 2 by means of the heavy line.

Figure 3:
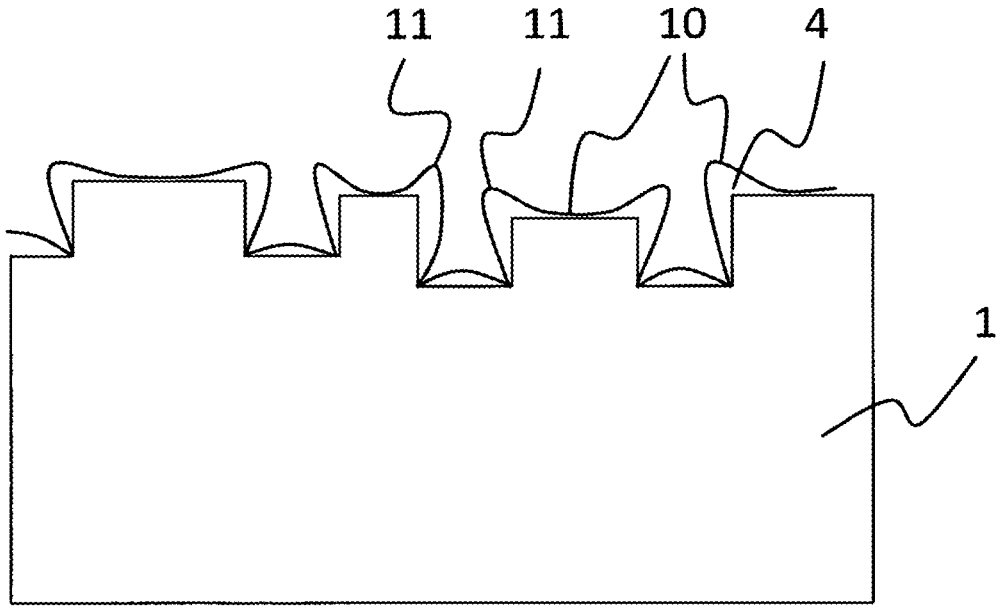
FIG. 3 shows an article coated with the electrolytic method according to the invention in a longitudinal section.

In FIG. 3, the coated article 1 from FIG. 2 is represented once again, with the coating 4 having been applied here by means of an electrolytic coating method. It is readily apparent here that the outer contour 10 in this implementation no longer follows the contour of the coated article. Instead, deposits of different thickness of the coatings are produced on the surface of the coated article, which essentially follow the field lines of the electric fields in the electrolyte bath. It is clearly visible here that a significant reduction in the distance between corner regions 11 can be achieved through the electrolytic coating, in particular in the corner regions 11. Consequently, significantly smoother surfaces can be created as compared to coating with an autocatalytic method, in that gaps or pores that are present are filled or made significantly smaller. This results on the whole in a significantly higher-quality surface of the finished, coated article 1.

The electrolytic coating method is additionally advantageous due to the fact that the entire component or the entire article 1 to be coated is not coated. Instead, it is possible to selectively coat regions of the article 1 to be coated, by which means unwanted coating of water-carrying sections can be avoided completely, but at least largely avoided. In the case of autocatalytic coating, this is not possible in this form without carrying out otherwise required and extremely resource-intensive covering or closure measures on the article 1 to be coated.

The present invention is distinguished, in particular, by high corrosion protection in decorative multilayer systems.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for coating an article, the method comprising:

applying a plurality of layers to at least part of a surface of the article, the plurality of layers together forming a coating on the at least part of the surface of the article;

wherein a first layer of the plurality of layers applied to the article is made of copper, a second layer of the plurality of layers is made of bright nickel, semi-bright nickel or matte nickel, a third layer of the plurality of layers is made of a nickel phosphorus alloy, and a fourth layer of the plurality of layers, which is applied directly to the third layer, is made of chromium, and wherein a mass fraction of the phosphorus in the nickel phosphorus alloy is at least 8%, and wherein the third layer made of the nickel phosphorus alloy is a fully continuous layer.

2. The method according to claim 1, wherein the article is made of copper, zinc, aluminum, iron, or plastic, or an alloy that includes copper, zinc, or steel.

3. The method according to claim 1, wherein the chromium of the fourth layer is deposited from a hexavalent or trivalent chromium electrolyte.

4. The method according to claim 1, wherein at least the third layer made of the nickel phosphorus alloy is applied electrolytically.

5. The method according to claim 1, wherein a fifth layer of the plurality of layers is applied on the fourth layer, the fifth layer being produced from an amorphous carbon layer (DLC).

* * * * *